United States Patent [19]

Kubit

[11] Patent Number: 4,637,974

[45] Date of Patent: Jan. 20, 1987

[54] XEROGRAPHIC COPYING ON A TRANSPARENT SHEET

[75] Inventor: Raymond G. Kubit, Fox River Grove, Ill.

[73] Assignee: Weber Marking Systems, Inc., Arlington Heights, Ill.

[21] Appl. No.: 691,352

[22] Filed: Jan. 10, 1985

Related U.S. Application Data

[63] Continuation of Ser. No. 485,208, Apr. 15, 1983.

[51] Int. Cl.[4] ..... G03G 13/16

[52] U.S. Cl. ..... 430/126; 430/30; 430/13

[58] Field of Search ..... 430/934, 12, 13, 30, 430/126; 118/668

[56] References Cited

U.S. PATENT DOCUMENTS

| | | | |
|---|---|---|---|
| 1,588,869 | 6/1926 | Wolk | 430/14 |
| 1,605,056 | 11/1926 | Numan | 428/38 |
| 3,671,121 | 6/1972 | Albert | 355/7 |
| 3,972,613 | 8/1976 | Plumadore | 355/75 |
| 4,249,328 | 2/1981 | Plumadore | 40/158 B |

OTHER PUBLICATIONS

Imaging Guide, 3M Publications, St. Paul, Minn.

3m Publication No. 78-1751-9069-9(06.10)PD, 1980, St. Paul, Minn.

*Primary Examiner*—John D. Welsh

*Attorney, Agent, or Firm*—Gerlach & O'Brien

[57] ABSTRACT

A transparency to be imaged as a copy sheet in plain paper copiers includes a transparent sheet having a surface adapted to receive an image imprinted thereon in the copier, and an opaque coating forming an opaque border completely around the sheet.

4 Claims, 4 Drawing Figures

XEROGRAPHIC COPYING ON A TRANSPARENT SHEET

This is a continuation of co-pending application Ser. No. 485,208, filed Apr. 15, 1983.

BACKGROUND OF THE INVENTION

This invention relates to transparencies to be imaged by a xerographic process, more particularly, to transparencies to be imaged in plain paper-type copiers.

In a "plain paper-type" copier, a copy of an original can be made by the xerographic process on a paper copy sheet of rectangular configuration, which has no special coating. The xerographic process includes the steps of transferring a toner image, formed by conventional means on a photoconductive surface of the copier, to the copy sheet, then fixing the image by fusion of the toner thereto. The fusion most frequently is accomplished by the application of heat to the surface of the copy sheet.

A plain paper copier can be used to copy images from an original onto a transparent copy sheet, of like configuration to the paper sheets and typically made from a thin film of an organic resin, such as a polyester resin. The transparent copy sheets, or "transparencies," as they are commonly known, which are intended for being imaged in plain paper copiers are especially adapted for this use, since the transparent base sheets have neither the same surface, nor the same bulk characteristics as have the opaque cellulosic paper copy sheets for which plain paper copiers originally were designed. For example, a transparent base sheet may be coated, to provide a surface adapted for adheringly receiving, and for having fused thereon, the toner image. The imaged transparency advantageously is used for projecting the image onto a suitable surface, for viewing purposes.

The transparent nature of the transparencies presents a problem, however, in that the transparencies may not be usable in plain paper copiers of the kind which employ opacity sensors to detect the presence of copy sheets in the external feed to the copier and/or in the path followed by a copy sheet as it moves through the copier. These sensors are activated by, or respond to, the presence of opacity in the path of a beam of light, visible or infrared, emitted by a suitable source for impinging upon the sensor. In such copiers, if no opacity is present on a copy sheet, the copier will not operate to image the copy sheet.

Transparencies are commercially available for use with certain plain paper copiers having opacity sensors. These transparencies make use of the fact that the opacity sensors of the copiers are positioned therein to respond to a relatively narrow opaque area, which is proximate to an outer edge of a copy sheet. The transparencies are provided with an opaque stripe running along one edge of the sheet, which stripe serves to activate an edge-reading opacity-sensor.

The disposition of edge-reading opacity sensors in plain paper copiers, and the operational requirements of such copiers, are not standardized. The requirements as to whether a stripe must be provided on a longer or on a shorter edge of an elongate rectangular transparency vary with the particular make and/or model of copier. Similarly, the specific orientation of a striped transparency with respect to the copy sheet feed input, and/or to the direction of movement of the copy sheet through the copier, is dependent upon the requirements of the manufacturer of the copier. For example, some copiers require that the striped edge be the leading edge of the copy sheet, i.e., the edge first to enter the copier, and that this edge be perpendicular to the direction of copy sheet movement. Other copiers call for the striped edge to be parallel to the direction of copy sheet movement.

It may occur that an office will have a diversity of plain paper copiers, each perhaps with a different type of copy sheet sensor. Further, the copiers with edge-reading opacity sensors each may have distinctive requirements as to the location of the stripe on a transparency adapted for use with the copier. Consequently, to be able to utilize the maximum number of copiers in an office for making imaged transparencies, several different types of striped transparencies may have to be stocked. Similarly, distributors are required to stock the several types of transparencies. It would be desirable to minimize the number of transparency types that must be stocked.

Also, the requirements of the copier in regard to the orientation of the sheet relative to the copier must be observed by the operator. Increased time taken by an operator to ensure proper orientation increases the overall cost of making an imaged transparency. It would be desirable also to provide a transparency requiring relatively little care and expenditure of time in feeding the transparency to a copier.

SUMMARY OF THE INVENTION

It is therefore an object of the present invention to provide an improved transparency for use in plain paper copiers having diverse requirements regarding the presence and location of opacity on a copy sheet fed thereto.

Another object is to provide such a transparency which can be fed into the copier in any orientation which the machine will accept.

In accordance with the invention, there is provided an improved transparency to be imaged as a copy sheet in a plain paper-type copier, such transparency including a transparent sheet having a surface adapted to receive an image imprinted thereon in the copier, wherein the improvement comprises an opaque coating provided on a surface of the sheet and forming an opaque border completely around the sheet, for activating a sensor in a plain paper-type copier controlled thereby.

A transparency of this invention, of rectangular configuration, has an opaque border, or stripe, along each of its edges. When the transparency is oblong or elongate, the border extends along both of its longer edges, and along both of its shorter edges, so that it can be used either with plain paper copiers which require an opaque border on a longer edge, or with copiers which require an opaque border on a shorter edge. The presence of an opaque border along all four edges of the transparency also permits it to be fed into a copier relatively indiscriminately, i.e., depending upon the requirements of the copier, with either of its shorter edges, or with either of its longer edges, as the leading edge.

The border of the new transparency serves not only to activate edge-reading opacity sensors, but also forms an aesthetically attractive dark frame surrounding the image projected from an imaged transparency, for example, by a conventional overhead projector. In addition, the border provides a convenient site for holding and handling the transparency without smudging or marring the transparent area thereof, and for making notations on the transparency.

BRIEF DESCRIPTION OF THE DRAWINGS

The attached drawing illustrate preferred embodiments of the invention without limitation thereto. In the drawings, like elements are identified by like reference elements in each of the views, and.

DESCRIPTION OF THE PREFERRED EMBODIMENTS

Figure 1:
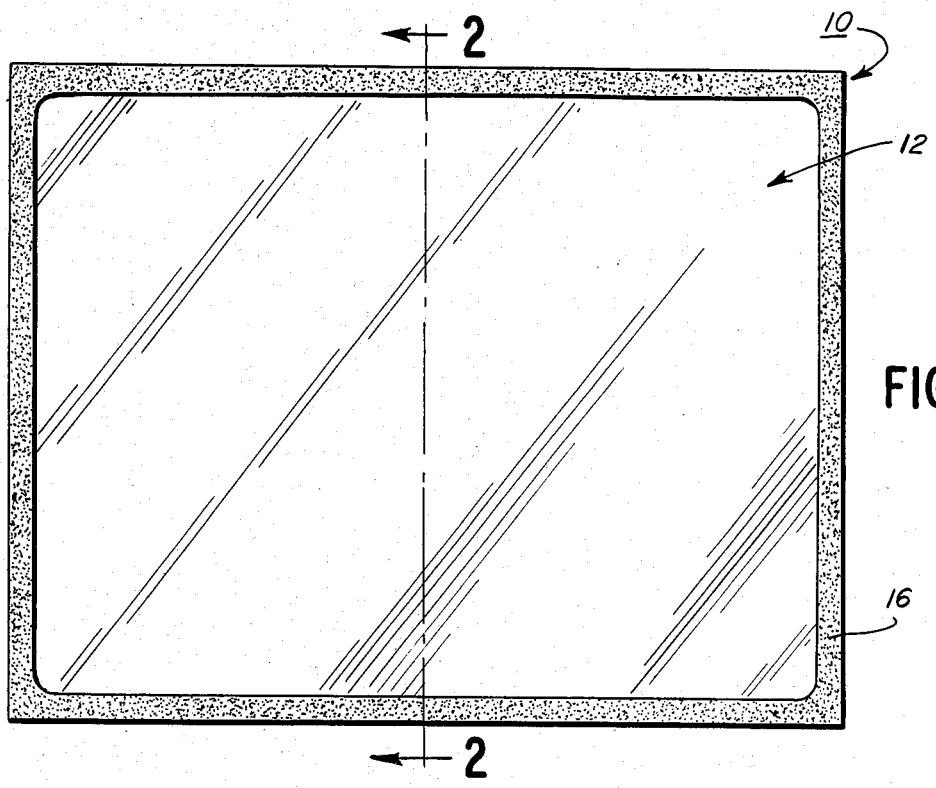
FIG. 1 is a top plan view of a transparency in accordance with the invention.
Figure 2:
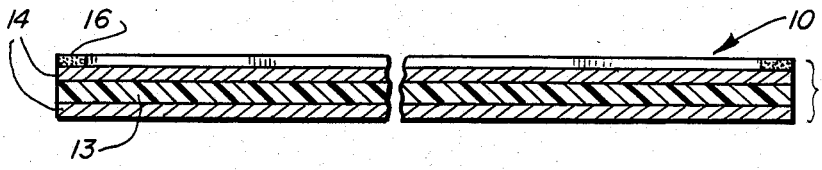
FIG. 2 is a sectional view taken substantially on line 2—2 of FIG. 1 and with certain dimensions greatly enlarged for clarity.

Referring to FIGS. 1 and 2 of the drawings, a transparency or transparent copy sheet 10 in accordance with the invention includes a transparent, rectangular composite sheet 12, which includes a transparent base film 13 and a transparent image- or toner-receiving layer or coating 14 disposed on each of the opposite surfaces of the film 13. The transparency 10 further includes an opaque coating 16 on a surface of the sheet 12 and forming an opaque rectangular border completely around the sheet. More particularly, the coating 16 is disposed on the outer surface of one of the image-receiving layers 14.

Figure 3:
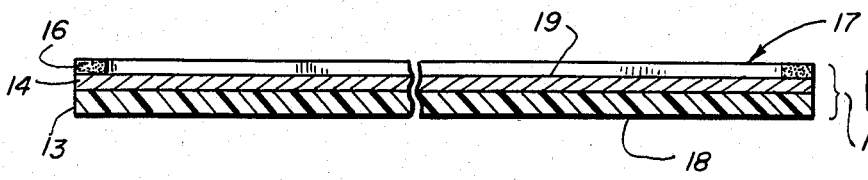
FIG. 3 is a view, similar to FIG. 2, illustrating another embodiment of the invention.

Referring to FIG. 3, a transparency or transparent copy sheet 17, representing an alternative embodiment, includes a transparent, rectangular composite sheet 15, which includes the transparent base film 13 and the transparent image-receiving layer 14 provided on but one surface of the film 13. The transparency further includes the opaque coating 16 disposed on the outer surface of the image-receiving layer 14 of the sheet 15.

The film 13 preferably is composed of a transparent, flexible material able to withstand the high temperatures conventionally utilized in many commercial plain paper copiers for fusing the toner image to the copy sheet. The fusion often is effected by heating the entire surface of a copy sheet by contact with a heated fuser surface. The temperature of the fuser surface typically is in the range of from about 320° F. to about 400° F. A general description of the xerographic plain paper copy process and of transparent film materials suitable for use therewith is given in, for example, U.S. Pat. Nos. 3,854,942 and 4,320,186.

While any of the film materials disclosed in the foregoing patents generally is suitable for use in the present invention, it is preferred to use a polyester film material, more preferably heat stabilized, biaxially stretched poly(ethylene terephthalate) (PET) material. Especially preferred are such PET film materials which have been treated to develop "adherable" surfaces, i.e., treated to render their surfaces more readily adherable to coatings placed thereon. A useful technique involves scarifying the surfaces with sodium hydroxide. Preferable commercially available adherable PET films include XM-728 adherable Mylar (DuPont) and Celanar 4500 series polyester film (Celanese). The thickness of the film can range from 2 to 7 mils, with a range of 2–5 mils being preferred.

A plain paper copier is able to form permanent fused toner images on cellulosic paper having no surface coatings especially applied thereto to promote toner adherence. However, unmodified PET film, even film having "adherable" surfaces, generally is not suitable for use in these copiers: the fused toner does not adhere strongly enough to the PET surface to resist being abraded off relatively easily, thereby destroying the image. Therefore, it is conventional. to coat one surface, or both surfaces, of a transparent film for use in plain paper copiers with an image-receiving layer, or layers, such as the layers 14. Each layer 14 forms a surface adapted for adheringly receiving, and for having fused thereto, a toner image.

The image-receiving layer of a transparent copy sheet for use in a plain paper copier itself is transparent and is designed to remain substantially unchanged in appearance when subjected to any heat applied to the surface of the sheet during the fusing of toner. The image is formed of fused toner on the outer surface of the layer, and not in the layer to any substantial extent.

The image-receiving layer or layers preferably are formulated to minimize static electricity and thereby minimize difficulties in the feeding of multiple sheets from a stacked pile thereof. Also, colorants or tints may be added to the layer, if desired for aesthetic or glare-reducing purposes. A preferred coating is disclosed in copending U.S. patent application Ser. No. 485,207, filed Apr. 15, 1983, by Stephen L. Walker and Beatrice E. Thorpe, for "TRANSPARENCY AND METHOD OF MAKING," which is assigned in common with the present application. Other suitable coatings providing image-receiving layers are disclosed in, for example, the hereinabove mentioned U.S. Pat. Nos. 3,854,942 and 4,320,186.

One or both surfaces of the base film 13 is coated to provide an image-receiving layer 14 thereon. Any of various coating techniques may be employed, such as roller or air knife coating. While it is preferred for convenience in use to provide a layer 14 on each surface of the film 13, as illustrated in FIG. 2, a layer 14 may be provided on but one surface of the film 13, if desired, as illustrated in FIG. 3. In the latter case, the transparency 10 must be fed into the copier so that the toner image will be applied to the outer surface of the single layer 14.

The transparency 10 is completed by applying the border-forming coating 16 to either of the outer surfaces of the film 13 provided with one or two layers 14. FIGS. 2 and 3 illustrate the coating 16 applied to a layer 14, thus insuring good adhesion of the coating. Also, it is advantageous in use to apply the coating 16 to the layer 14 which, in the usual or recommended practices, is the layer which will be imaged. Then, any notations or markings on the coating 16 will be visible to the operator when an imaged transparency is placed on the light stage of an overhead projector with the image on top. However, the coating 16 may, alternatively, be applied to the exposed surface 18 of the film 13, instead of to the surface 19 of the layer 14, when the film 13 is provided with but a single image-receiving layer 14, as in FIG. 3. In principle, the alternative application of the coating 16 may precede the application of the single layer 14.

The coating 16 may be formulated of any opaque material or composition which will adhere to the layer 14, or to the film 13 when applied thereto, and which is capable of withstanding the operating conditions of a plain paper copier. Such materials are well known and include paints, varnishes, hot-melt resins, and inks. The preferred composition is an ink, and more preferably a flexographic ink. A suitable commercial flexographic ink is White Flexographic Ink #2022R, made by Ink Specialties Manufacturing Co.

The coating 16 can be applied by conventional methods. When using a flexographic ink, it is preferred to use printing techniques employing, for example, a roll-fed or a sheet-fed flexographic press.

The degree of opacity of the coating 16 must be sufficient to activate the opacity sensor of a plain paper copier. It has been found that the opacity generally is sufficient when an opaque mark made on the coating 16 is not projected onto a viewing screen when the transparency 10 is placed on the light stage of a Model 213 overhead projector (Minnesota Mining and Manufacturing Co.). Provided the requirements for opacity are met, the coating 16 may be of any color. However, a light color, such as white, is desirable to provide maximum contrast with any dark notations or markings made on the coating 16.

A xerographic transparency which may be imaged in any of the plain paper copiers known to me having edge-reading opacity sensors, in any orientation acceptable by the machine, is provided by the coating 16 in a border width of substantially ½-inch, completely around the sheet 12. The sheet itself may have such dimensions as are acceptable to the copiers and suited to the intended use of the transparency. The standard size overhead projection transparency is 8½×11 inches, and 11×11-inch transparencies also are used. Thus, an 8½×11-inch transparency having a ½-inch border therearound fulfills the needs for the standard size transparency, while an 11×11-inch transparency having a ½-inch border therearound fulfills the needs for the larger size.

Many of the plain paper copiers require but a ¼-inch border width for activating their sensors. When a maximum amount of image or transparent area within the border is desired, the width of the borders of transparencies to be imaged in such copiers may be reduced to a minimum of about ¼ inch. Therefore, the demand for each size transparency may be filled by providing a ½-inch border for universal use and a ¼-inch border for maximum image area when using the copiers which will function with such border width. If desired, the width of any portion of such borders may be increased, such as where it is desirable to narrow the image or transparent area of the transparency for projection or viewing purposes, especialy in the larger size transparencies.

Figure 4:
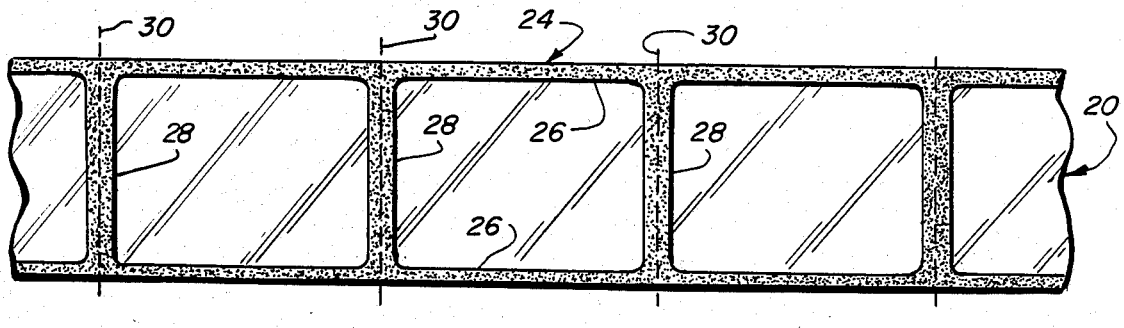
FIG. 4 is a fragmentary top plan view of an integral series of transparencies, prior to severance from each other in the last step of manufacture in accordance with the invention.

Referring to FIG. 4, a continuous strip or web 20 embodies a series of transparent sheets 12, which have been coated by a printing technique with an opaque pattern 24 of flexographic ink on a flexographic press (not shown), as described hereinabove. The width of the strip 20 corresponds to the width of the sheets 12. The pattern 24 includes continuous parallel stripes or bands 26 extending along the opposite edges of the strip 20, and spaced apart parallel transverse stripes or bands 28 which intersect the longitudinal stripes 26, perpendicularly thereto. The width of the longitudinal stripes 26 is equal to the width desired for the border formed by the coating 16, while the width of the transverse stripes 28 is twice the width desired for such border. The center lines 30 of the transverse strips 24 are spaced apart a distance corresponding to the length of the sheets 12. Using a conventional sheeting cylinder (not shown), the strip 20 and the pattern 24 thereon are cut along the center lines 30, to provide individual transparencies 10, ready for use.

While certain preferred embodiments of the invention have been illustrated and described herein, it will be apparent to those skilled in the art that various changes and modifications may be made, within the spirit and scope of the invention. It is intended that all such changes and modifications be included within the scope of the appended claims.

I claim:

1. In a method of making a xerographically imaged transparency wherein an unimaged transparent copy sheet is imaged in a plain paper-type copier, said copier embodying a photoconductive surface on which a toner image is formed, said copy sheet comprising a transparent base film having a transparent coating thereon adapted for receiving and for having fixed thereto a toner image transferred from said photoconductive surface, said copier also embodying an opacity sensor which controls the operation of the copier and which is activated by copy sheet opacity, the improvement for activating indiscriminately the sensors of different copiers having diverse opacity location requirements and for activating such sensors with the transparent copy sheet in any angular disposition in which it is received by their respective copiers, which comprises employing in said method a transparent copy sheet in order to activate said sensor with an opaque border therein that extends completely around the sheet and encompasses on unimaged transparent area of the sheet.

2. A method as defined in claim 1 wherein said border is provided by an opaque coating deposited on an element of the copy sheet.

3. A method as defined in claim 1 wherein said border is provided by an opaque coating deposited on said transparent coating.

4. A method as defined in claim 3 wherein the width of said border is at least about one-quarter inch.

* * * * *

UNITED STATES PATENT AND TRADEMARK OFFICE

CERTIFICATE OF CORRECTION

PATENT NO. : 4,637,974

DATED : January 20, 1987

INVENTOR(S) : Raymond G. Kubit

It is certified that error appears in the above-identified patent and that said Letters Patent are hereby corrected as shown below:

Column 6, line 43, cancel "in order to".

Column 6, line 44, cancel "activate said sensor".

Column 6, line 46, change "on" to -- an --.

Column 6, line 46, after "sheet" insert -- in order to activate said sensor --.

FIG. 2: Delete and substitute corrected FIG. 2 as shown on the attached drawing sheet FIG. 3: Delete and substitute corrected FIG. 3 as shown on the attached drawing sheet

UNITED STATES PATENT AND TRADEMARK OFFICE

CERTIFICATE OF CORRECTION

PATENT NO. : 4,637,974

DATED : January 20, 1987

INVENTOR(S) : Raymond G. Kubit

It is certified that error appears in the above-identified patent and that said Letters Patent is hereby corrected as shown below:

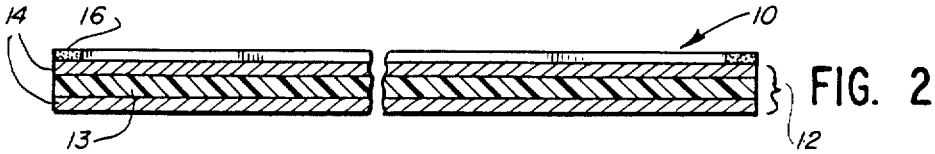

FIG. 2

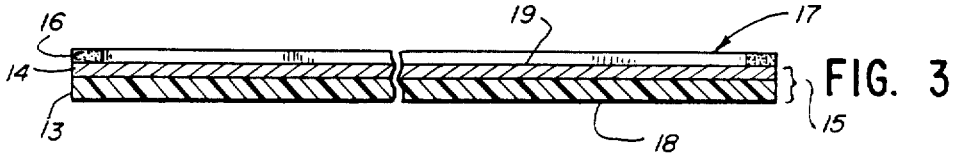

FIG. 3

Signed and Sealed this

Twenty-seventh Day of October, 1987

*Attest:*

DONALD J. QUIGG

*Attesting Officer*

*Commissioner of Patents and Trademarks*